United States Patent [19]

Beck

[11] Patent Number: 4,459,506

[45] Date of Patent: Jul. 10, 1984

[54] INCANDESCENT ILLUMINATING DEVICE WITH ANTIFRAGILITY COATING

[75] Inventor: Charles K. Beck, Mentor, Ohio

[73] Assignee: Premier Industrial Corporation, Cleveland, Ohio

[21] Appl. No.: 440,179

[22] Filed: Nov. 8, 1982

[51] Int. Cl.[3] ..... H01K 1/32

[52] U.S. Cl. ..... 313/315; 313/317; 313/578; 427/106

[58] Field of Search ..... 313/315, 317, 312, 578, 313/116; 427/106, 107

[56] References Cited

U.S. PATENT DOCUMENTS

| | | |
|---|---|---|
| 389,526 | 9/1888 | Moore . |
| 1,854,988 | 4/1932 | Fuwa et al. . |
| 1,873,951 | 8/1932 | Zocher . |
| 2,706,262 | 4/1955 | Barnes . |
| 2,859,369 | 11/1958 | Williams et al. . |
| 2,862,834 | 12/1958 | Hiler . |
| 2,901,646 | 8/1959 | Plagge et al. . |
| 2,946,911 | 7/1960 | Malinowski et al. . |
| 3,048,734 | 8/1962 | Linnes . |
| 3,067,352 | 12/1962 | Vodicka et al. . |
| 3,110,614 | 11/1963 | de Vries . |
| 3,200,280 | 8/1965 | Thau et al. . |
| 3,209,192 | 9/1965 | Decker . |
| 3,223,273 | 12/1965 | Thorington . |
| 3,365,315 | 1/1968 | Beck . |
| 3,462,632 | 9/1969 | Russi . |
| 3,529,035 | 9/1970 | Lamoreaux . |
| 3,619,256 | 11/1971 | Pepe . |
| 3,621,323 | 11/1971 | Thomas . |
| 3,661,673 | 5/1972 | Merriam . |
| 3,715,232 | 2/1973 | Audesse et al. . |
| 3,851,200 | 11/1974 | Thomasson . |
| 3,983,265 | 9/1976 | Letoffe . |
| 4,112,179 | 9/1978 | Maccalous et al. . |
| 4,112,485 | 9/1978 | Sutter . |
| 4,148,955 | 4/1979 | Brietenfellner et al. . |
| 4,163,081 | 7/1979 | Schulz . |
| 4,307,142 | 12/1981 | Blitstein et al. . |
| 4,332,329 | 6/1982 | Scriven et al. ..... 427/106 |

FOREIGN PATENT DOCUMENTS

| | | |
|---|---|---|
| 694108 | 9/1964 | Canada . |
| 1283421 | 11/1968 | Fed. Rep. of Germany . |

OTHER PUBLICATIONS

Shatterproof Coatings for Glass by R. J. Gray, Metals and Ceramics Division; Contract No. W-7405-eng-26, Oak Ridge Library.

Emerson & Cummings, Inc. Preliminary Bulletin 14--2-4.

The PQ Corporation PQ-Bulletin QC-13.

"Competition for New Applications Pushes Improvements in SMC & BMC," Clavadetscher et al., 1977, *Plastics Design & Processing* Q-CEL Bulletin QC-10.

*Materials Engineering*, Oct. 1978 Wehrenberg Article.

*Primary Examiner*—Eugene R. Laroche
*Assistant Examiner*—K. Wieder
*Attorney, Agent, or Firm*—Yount & Tarolli

[57] ABSTRACT

An incandescent illuminating device having an antifragility coating covering at least a substantial portion of the glass envelope, the antifragility coating comprising a mixture of a relatively clear, resilient heat-stable polymer capable of adhering to glass and a plurality of light-transmitting, impact-absorbing particles, which are preferably small, hollow, heat-stable, frangible microspheres. The particles, preferably hollow microspheres, constitute from about 20% to about 60% by volume of the cured antifragility coating and are essentially colorless, have a high degree of light transmissivity, and have a low density and a diameter less than about the thickness of the antifragility coating. The particles act as a sacrificial material to absorb an impact giving the coating antifragility properties.

9 Claims, 3 Drawing Figures

INCANDESCENT ILLUMINATING DEVICE WITH ANTIFRAGILITY COATING

FIELD OF THE INVENTION

The present invention relates to an incandescent illuminating device with an antifragility coating.

BACKGROUND OF THE INVENTION

Incandescent illuminating devices are available with a safety coating of silicone rubber to prevent scattering of fragments of the glass envelope upon fracture. However, the coating does not act as an antifragility coating, i.e., such coatings do not provide any significant protection against cracking or breaking of the glass envelope. The silicone rubber acts only as a "safety net" to prevent scattering of pieces of the shattered glass envelope after fracture. Even though the coating provides antiscattering properties, once the envelope is broken the bulb is of no value. Also, because such safety bulbs are generally coated with a silicone rubber on a clear, unetched envelope, the filament of the bulb appears as a bright spot causing an optical glare.

SUMMARY OF THE INVENTION

The present invention provides an antifragility coating covering at least a substantial portion of a fragile glass envelope of an incandescent illuminating device. The antifragility coating employs a light-transmitting polymer adhering to the glass envelope with light-transmitting, impact-absorbing particles in the polymer. These particles are capable of fracturing, responding or deforming under pressure in such a fashion so as to absorb an impact force which would otherwise break the glass envelope.

The antifragility coating preferably comprises a mixture of a relatively clear, heat-stable polymeric binder, which is capable of adhering to glass, and a plurality of hollow, heat-stable, frangible microspheres. The hollow microspheres constitute from about 20% to about 60% by volume of the cured antifragility coating, preferably from about 25% about to 50% by volume, and most preferably from about 35% to about 45% by volume. The hollow microspheres are essentially colorless, have a high degree of light transmissivity, and have a low bulk density and a diameter less than about the thickness of the antifragility coating.

Hollow microspheres having a diameter in the range from about 12 microns to about 750 microns are useful in the present invention; the preferred microspheres have a diameter in range from about 20 microns to about 200 microns, and most preferably in the range from about 40 microns to about 150 microns. The microspheres are hollow and preferably comprise a material selected from the group consisting of glass, alkali metal silicates, silicon dioxide, and mixtures thereof.

The antifragility coating has a thickness from about 3 mils (75 microns) to about 30 mils (750 microns), preferably from about 4 mils (100 microns) to about 12 mils (300 microns), and most preferably from about 6 mils (150 microns) to about 10 mils (250 microns).

Both the polymer and the hollow microspheres must be heat-stable, which in the context of an incandescent illuminating device means that they must withstand prolonged exposures to temperatures in excess of about 350° F. (176° C.), preferably in excess of about 400° F. (204° C.).

The polymeric binder should also be relatively clear, have a high degree of light transmissivity and have a substantial degree of resiliency. Silicone rubbers are preferred for the polymeric binder.

The antifragility coating of the present invention achieves a light transmissivity in excess of about 85% compared to a clear glass envelope and is optimally in the range from about 92% to about 95% of the transmissivity of a clear glass envelope.

The coating of the present invention possesses excellent antifragility and antiscattering properties. In addition, an incandescent bulb coated in accordance with the present invention has improved filament efficiency, improved diffusivity, improved directional light transmissivity from the lateral portion of the bulb, improved resistance to breakage by cold and hot materials, and cost advantages.

The impact-absorbing particles act as a sacrificial material to absorb impact energy and fracture or deform under impact thus reducing substantially the tendency of the glass envelope to break. Breakage of the particles leaves voids in the binder. These voids are available to absorb any further impact energy in the event of repetitive impacts to the same area of the envelope.

DESCRIPTION OF PREFERRED EMBODIMENTS

Figure 1:
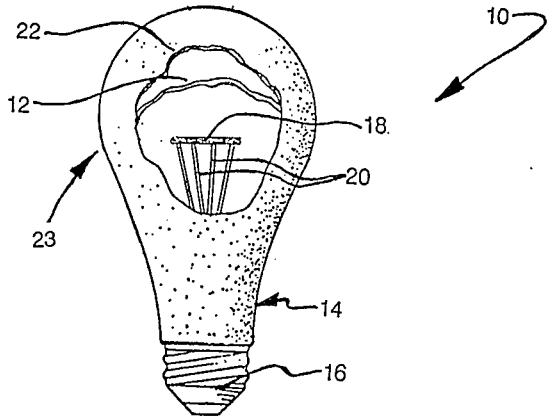
FIG. 1 is a side elevational view of an incandescent illuminating device according to the present invention partially broken away to show the filament on the interior of the bulb.

With respect to the drawings, FIG. 1 shows a common form of incandescent electric lamp 10 having a coated glass envelope 12. The glass envelope 12 has a rounded head portion 23 and an adjacent, integrally attached neck 14. The neck portion 14 of the glass envelope 12 is secured into a conventional metal base 16. Located within the glass envelope 12 and secured to the metal base 16 is a filament 18. As is conventional in shock-resisting incandescent light bulbs, the filament 18 shown here is in the form of a partial circle and is supported by vertical supports 20.

The glass envelope 12 is coated with an antifragility coating 22 of the present invention. As explained in more detail below, the antifragility coating of the present invention comprises a mixture of a relatively clear, heat-stable, resilient polymer and essentially colorless, hollow, frangible microspheres. The antifragility coating of the present invention prevents breakage and shattering of the glass envelope 12 of the bulb 10 by physical impact or thermal shock.

Figure 2:
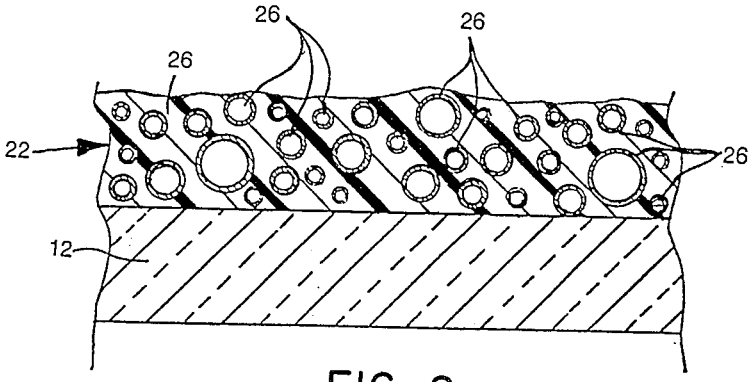
FIG. 2 is a sectional view taken through the wall of the glass envelope of the illuminating device of FIG. 1.

As shown in more detail in FIG. 2, the antifragility coating 22 is applied in a relatively uniform thickness over the surface of the glass envelope 12, and the coating 22 adheres to the outer surface of the glass envelope. The antifragility coating 22 covers at least a substantial portion of the outer glass envelope 12, and preferably covers the entire outer surface of the glass envelope 12.

The antifragility coating 22 comprises a relatively clear, heat-stable, resilient polymer 24 and a plurality of essentially colorless hollow microspheres 26. The microspheres are frangible and thus act as a sacrificial material as explained in more detail below. Depending on the thickness of the antifragility coating 22 and the diameter of the hollow microspheres 26, as well as the ratio of microspheres to polymer, the hollow microspheres will be encapsulated by the polymeric matrix at various depths throughout the antifragility coating, although some of the hollow microspheres may protrude sufficiently from the coating so as to create a roughened surface at the outer portion of the antifragility coating 22. However, generally the polymeric binder of the present invention at least forms a thin skin over any hollow microspheres protruding near the surface.

Figure 3:
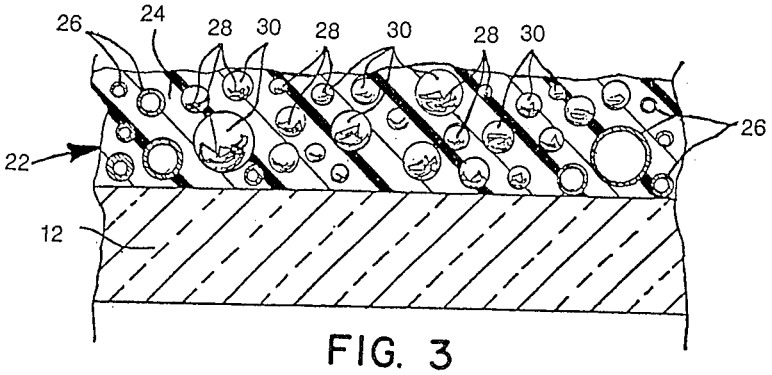
FIG. 3 is a sectional view similar to that shown in FIG. 2 after the illuminating device of FIG. 1 has been impacted.

FIG. 3 shows a cross sectional view similar to FIG. 2 of the incandescent bulb 10 of the present invention after the bulb has been impacted. The hollow microspheres 26 have acted as a sacrificial material by absorbing the force of the impact. As explained in more detail below, the glass envelope 12 remains intact and does not shatter or break unless, of course, the impact-absorbing capability of the coating has been exceeded. The shattered particles 28 of the frangible, hollow microspheres are illustrated in FIG. 3. A void 30 remains in the binder 24 for each hollow microsphere shattered by the impact. As shown in FIG. 3, at the center of the impact all of the hollow microspheres 26 throughout the depth of the antifragility coating 22 have been shattered, whereas at the circumference or outer perimeter of the impact zone, only the hollow microspheres near the outer surface of the antifragility coating have been shattered.

Unless otherwise noted, the amount of hollow microspheres used in the present invention will be expressed as a percentage by volume of the cured coating 22 on the glass envelope 12. The percentage by volume of hollow microspheres to be used in the antifragility coating of the present invention depends on a variety of mechanical and optical properties desired for the incandescent illuminating device. For certain uses, some properties may be of greater importance than others. In other cases it may be necessary to compromise various mechanical and optical properties. For example, the extent of the antifragility property is a function of the concentration of microspheres in the coating. Too low a concentration of the microspheres results in little or no antifragility property. Too high a concentration of microspheres results in an undesirable reduction of coating resiliency. Prevention of scattering of broken pieces once the glass envelope is fractured requires a coating having a reasonably high tensile strength and elongation. Those two properties tend to conflict somewhat since resistance to fracture of the glass envelope by impact or thermal shock increases as the percentage by volume of microspheres increases, while resiliency tends to decrease as the amount of microspheres increases. Diffusivity, i.e., the extent of diffusion of light through the coating of the present invention, also can be varied depending on the concentration of the microspheres in the cured coating. The lower the concentration of microspheres, the less diffusing the coating becomes. However, if the percentage of microspheres is increased too much, the light output is attenuated. In addition, too high a concentration of microspheres results in a coating having rheological properties which make application of the coating to a bulb very difficult. The best thermal insulating properties are achieved with the highest concentration of microspheres present while concurrently avoiding direct particle-to-particle contact. The higher the percentage of microspheres, the cheaper the antifragility coating tends to be because the cost of the microspheres is generally below the cost of the heat-stable polymeric binder.

In considering the foregoing properties and factors, it has been found in accordance with the present invention that the hollow microspheres should comprise from about 20% to about 60% by volume of the cured coating, preferably from about 25% to about 50%, and most preferably from about 35% to about 45% by volume of the cured coating.

Considerations leading to variations in particle content also lead to a range of suitable coating thicknesses. A balance of the diffusivity and antifragility properties is important. From an antifragility standpoint, a higher concentration of hollow microspheres permits a thinner coating, and conversely, a lower volume of hollow microspheres requires a thicker coating. From a light transmissivity standpoint, the thicker the coating, the more light is attenuated; and the higher the percentage of microspheres for a given thickness, the more light is attenuated. Thus, the coating thickness and the concentration of the hollow microspheres are interrelated. Generally, it has been found that the coating thickness of the present invention should be from about 3 mils (75 microns) to about 30 mils (750 microns), preferably from about 4 mils (100 microns) to about 12 mils (300 microns), and most preferably from about 6 mils (150 microns) to about 10 mils (250 microns).

Another property of the incandescent illuminating device of the present invention is improved light transmissivity, i.e., the amount of light transmitted from a filament. Incandescent illuminating devices of the present invention are generally designed to transmit as much light as possible. Transmissivity should be balanced with diffusivity to attempt to maximize the transmission of light while still obtaining an incandescent illuminating device that sufficiently diffuses the light so as not to have a glare or the appearance of a point source. Accordingly, the composition of the antifragility coating of the present invention can achieve and has been designed to achieve at least about 85% of the light transmitted compared to an uncoated incandescent illuminating device. Thus, an electric light bulb coated according to the present invention can transmit at least about 85% of the amount of light transmitted by an uncoated bulb having a clear glass envelope, and the preferred coatings of the present invention transmit approximately about 92% to about 95% of the light transmitted by an uncoated glass envelope.

The polymeric binders of the present invention must be light transmitting. For best performance, the polymeric binders of the present invention should have the following properties: heat-stable, essentially colorless, high degree of light transmissivity, some adhesion to glass, good elongation, resiliency, and the ability to be applied as a solution, dispersion, or emulsion. The polymeric binder of the present invention should be heat-stable since incandescent lamps become hot when in use. Many incandescent lamps in operation heat the glass envelope to temperatures of about 450° F. (232° C.) while other incandescent lamps may achieve glass envelope temperatures exceeding 500° F. (260° C.). Accordingly, the polymeric binder of the present invention should be heat-stable. For purposes of good light transmissivity, the polymer should be relatively clear, and except for special applications essentially colorless. Coatings in accordance with the present invention are relatively clear and essentially colorless even though to the naked eye the coating appears white as applied to an electric light bulb. Since the antifragility coating is applied on the glass envelope, it should have some adhesion to glass. The necessary mechanical properties of the antifragility coating also require a fairly good elongation at break, and preferred polymers of the present invention have a minimum of about 10% elongation at break. The mechanical requirements of the present invention also dictate that the antifragility coating have a certain resiliency. Ease of application requires that the coating be applied as a liquid. The polymer or a precursor of the polymer preferably exists in the liquid state either in the neat condition or as a solution, dispersion or emulsion in at least one other liquid medium.

Many silicone rubbers or elastomers will satisfy the foregoing properties. Such silicone rubbers are commercially available at reasonable prices and are therefore preferred materials for the present invention.

Silicone rubbers useful in the present invention have extended chains of linked, alternate silicon atoms and oxygen atoms, known as "siloxane" chains, each silicon atom generally bearing two organic groups, as follows:

$$(R_2SiO)_X$$

in which R represents, in conventional silicone rubbers, a methyl ($CH_3$) group. It is to be noted, however, that increased resistance of the silicone rubber to degradation at elevated service temperatures may be achieved by the substitution of phenyl ($C_6H_5$) groups for a portion of the methyl groups attached to the silicon atoms.

In the final stage of rubber formation, the extended polymer chains are bonded to other, neighboring polymer chains at random points along their length through various cross-linking processes, also known as "vulcanization". Several methods are used for the cross-linking or "curing" of silicone rubber compositions. These mechanisms include: oxidative cross-linking of chains through the attached R groups by oxidative processes at elevated temperatures, carbon-carbon atom polymerization reactions made possible by the substitution of a minor portion of the methyl groups by unsaturated groups such as vinyl ($C_2H_3$) for example, or by condensation reactions between moisture-sensitive, labile groups attached to silicon atoms in minor proportion, such as, for example, aceto or amino groups, some of which may be attached to tri-functional or tetra-functional silicon atoms for the purpose of expediting the cross-linking process. The process of cross-linking, vulcanization, or other mechanism of curing, stiffens and strengthens the structure of the rubber, but must be carefully controlled for, if carried to too great an extent, it will render the rubber brittle and of low resilience.

Silicone rubbers are intermediate in tensile strength, generally ranging from about 600 to 1500 lbs per square inch breaking strength. They generally have good abrasion resistance, flex resistance, tear resistance, and impact resistance, with excellent deformation capability, elasticity, and resilience. Unlike hydrocarbon-based rubbers, they generally are suitable for uses at temperatures from 200°-260° C. whereas the maximum recommended operating temperature for natural and most synthetic rubbers is limited to about 100° C.

Since silicone rubbers possess properties suitable for the purposes of this invention, and are commercially available in quantity at reasonable prices, they are preferred materials for this invention. However, it will be understood by those skilled in the art that other elastomer systems having similar properties may be substituted for silicone, such as, for example, fluorinated hydrocarbon rubbers such as Viton®, provided that other factors such as color, transparency, and ease of application likewise are met. Although a majority of useful binder compositions will be applied as polymer precursors to be cured in-situ, it will be apparent to those skilled in the art that certain candidate binder materials may be applicable by deposition from solution through evaporation of solvent or by solidification from the molten state.

Some specific silicone rubbers available for use in the present invention are as follows:

(1) Dow Corning 3145 RTV clear adhesive/sealant is described as a one-part vulcanizing silicone rubber.

(2) Dow Corning 3-6550 RTV clear dispersion is a silicone rubber solvent dispersion and contains about 50% by weight of a room temperature vulcanizing silicone elastomer precursor and about 50% xylene.

(3) General Electric RTV 615 is a transparent, two-component liquid silicone rubber.

(4) Dow Corning R-4-3117 is a mixture comprising a solution or dispersion of a silicone in a volatile solvent. It can be cured by reaction with atmospheric moisture at ambient temperature, or by use of a catalyst and heat.

(5) Dow Corning 3140 RTV is described as a one-part solventless silicone rubber which is room temperature vulcanizing. The Dow Corning literature indicates that it is primarily used as a conformal coating. It cures by reaction with atmospheric moisture.

(6) Dow Corning Sylgard 186 encapsulating resin is described as a two-component, high tear and tensile strength, room temperature curing silicone elastomer. It can be cured at room temperature in a few days or by baking in a few minutes to a few hours depending upon the temperature used.

(7) Dow Corning Sylgard 182 is a solventless silicone resin. The cured resin has high tensile strength and good elongation, requiring both a curing agent and heat for curing.

(8) General Electric RTV 602 is a condensation cure RTV silicone rubber. It may be cured by one of several curing agents, and is usually cured at room temperature.

(9) General Electric RTV 118 is a one-component ready to use adhesive/sealant which cures by reaction with atmospheric moisture, utilizing an acetoxy cure system with acetic acid as a by-product.

(10) General Electric RTV 108 is similar to RTV 118 but of higher viscosity, being a paste rather than a fluid.

(11) General Electric RTV 158 is similar to RTV 108 and RTV 118, but has higher tensile strength and greater elongation.

The light-transmitting, impact-absorbing particles of the present invention are present in sufficient quantity to absorb the impact of a force by responding, fracturing or deforming under the pressure of the force. Hollow microspheres are preferred. The hollow microspheres of the present invention should have the following properties: relatively small, frangile, heat-stable, essentially colorless, hollow, and essentially transparent. The microspheres are relatively weaker in strength compared to the glass envelope so that the particles can act as a sacrificial material to deform or break under pressure. The same coating properties that enter into consideration in selecting a suitable polymeric binder also influence the selection of the hollow microspheres. While the microspheres in the present invention are, individually, essentially transparent, the microspheres in bulk appear white. The term "microspheres" is used throughout this specification and appended claims but it is obvious that the particles need not be perfect "spheres". Thus, the term "microspheres" will be used throughout the specification and claims to include hollow microparticles whether or not they are spherical.

The hollow microspheres are preferably formed of materials such as glass, alkali metal silicates, silicon dioxide, or other vitreous materials.

In terms of outside diameter, hollow microspheres from about 12 microns (0.5 mils) to about the maximum thickness of the cured coating, about 750 microns (30 mils), have been found useful. The preferred size of hollow microspheres is from about 20 microns to about 200 microns, and most preferably from about 40 to about 150 microns. Commercially available microspheres obviously have a distribution of different particle diameters within a given batch, the distribution depending on the extent of classification. Thus, the foregoing ranges are designed to include the bulk of the distribution of diameters of a given batch recognizing that some portion of the distribution may fall outside the range.

Particular hollow microspheres which are useful in the present invention are as follows:

1. P. Q. Corporation offers two types of microspheres useful herein, namely Q-Cel 200 and Q-Cel 300. They are described as inorganic microspheres composed of an inorganic silicate composition. The Q-Cel 300 is said to be stronger and to have a greater wall thickness than the Q-Cel 200.

2. The 3M Company offers microspheres sold under the name "glass bubbles". All of the microspheres are described as being composed of a soda-lime-borosilicate glass. The A and D series are floated on water to remove the beads which are not hollow. The D series has smaller particle sizes than the A series. The B and C series are not floated and are otherwise similar in their method of manufacture.

3. Emerson and Cuming offers a wide variety of microspheres. One class of Emerson and Cuming microspheres is made of sodium borosilicate glass. The first type is 1G 101, a standard industrial grade. 1G 101D grade has higher strength and a smaller average particle diameter. 1G-25 has a lower density, and about the same strength as 1G 101. R is a standard electrical grade. Another class of microspheres is made of silicon dioxide. The first type is SI, known for its high temperature resistance. There is also type VT which is a silicon dioxide particle. Also there are hollow particles of glass which have been treated by an ion exchange process which removes a large portion of the sodium atoms from the surface, and thus renders the glass less soluble. The first type is FT 102 which has moderate strength and moderate density. Next is FTD-202 which has moderate density and high strength. Next is FTL 200 which has low strength and low density. Finally there is FTF 15 which has extremely small particle size. The FTD-202 showed the best combination of chemical and physical characteristics for use in the present invention.

Light bulbs according to the present invention can be coated in a manner similar to safety bulbs of the prior art which are coated with a plain silicone rubber material. First, the incandescent light bulb surface should be cleaned and prepared for the antifragility coating. Once the lamp is prepared, the lamp can be coated in various ways known in the art. The details of the method of coating the light bulbs in accordance with the present invention basically involves thoroughly mixing the hollow microspheres with the polymeric binder followed by coating of the light bulbs and subsequent curing. The details of the coating process can be found in the following examples.

EXAMPLES

The present invention can be further understood by resort to the following examples.

Example 1

92.0 grams of Dow Corning 3-6550 silicone rubber was placed into a container and while being stirred slowly with a propeller mixer, 8.0 grams of Emerson and Cuming FTD-202 glass microspheres were added slowly. The mixing was continued until homogeniety was achieved (2–3 min.). The coating was then strained through a coarse Gerson strainer, sealed in a new container and allowed to stand until most of the entrained air had escaped.

An electric 100 watt incandescent lamp with shock-resistant filament mounting and known in the trade as 100 TSAG-5 Clear, was used for this example. This lamp had a clear, unetched, uncoated envelope.

The envelope was wiped with toluene to remove any surface contamination. An aluminum weighing dish was slotted in such a manner as to form a collar around the bulb at the junction of the envelope and the metal base, and the collar was secured with O rings. The lamp was then inserted in a standard socket, with care being taken not to touch the glass envelope. The socket and bulb were clamped to an electric motor for rotation about the longitudinal axis of the light bulb. This axis of rotation was set at about an angle of about 45° to the horizontal. The motor was connected to a variable autotransformer so as to control the rate of rotation of the bulb. The use of both gravity and centrifugal force on the light bulb achieves an even distribution of coating thereon.

The bulb was placed in the above coating apparatus and caused to rotate at about 80 rpm. The coating mixture then was poured over the spinning bulb starting at its apex and working toward the metal base. After the coating was applied, the rate of bulb rotation was increased by about 10 rpm and the spinning continued for about one hour. Then the bulb was removed from the spin coating apparatus. The collar and O rings were removed and the base was cleaned. The coated bulb was then supported by its base in a vertical position and allowed to air-dry for one week. During this period of time, the silicone polymer cured by reaction with the atmospheric moisture. Optionally, the coating can be further cured by being baked at one hour at 400° F. after the coating has air-dried for a week.

The bulbs were tested in the following manner. The bulb was fastened to a ring stand in such a manner that the longitudinal axis of the bulb was horizontal and at a 90° angle to the rod of the ringstand. An electromagnet was mounted above the bulb. Current was normally supplied to the magnet, but when a switch was thrown, the current would cease.

A ½" diameter steel ball was suspended 5 centimeters above the highest portion of the light bulb. The switch was thrown, causing the ball to drop and strike the light bulb. The bulb did not break, and it was rotated until a new area was exposed. The ball was dropped again at a height 5 centimeters higher than the previous drop. This process was continued until the bulb broke or until the top of the ringstand was reached. In the latter case, the test would then be started over using a ¾" diameter ball, and if breakage was not then achieved, finally a 1" diameter ball. For this particular example, breakage occurred at 55 centimeters using a ¾" ball, and the envelope did not shatter.

An uncoated 100 TSAG-5 clear bulb without a coating was similarly tested and it broke at 20 centimeters using a ¾" ball with severe shattering. Similarly, a 100 TSAG-5 frosted bulb, but without the coating of the present invention, broke at 25 centimeters using a ¾" ball. Finally, a 100 TSAG-5P bulb, frosted and coated with a standard Saf-T-Shield coating broke at 25 centimeters using a ¾" ball, but did not shatter.

Example 2

A bulb was coated in a manner similar to Example 1 with the exception that the coating comprised 24.9 grams of xylene, as a solvent, and 61.5 gms of RTV-118 silicone rubber mixed with 13.6 gms of FTD-202 microspheres. When tested, a bulb coated with this coating did not break when struck with a steel ball of 1" in diameter dropped from a height of 70 centimeters. A similar uncoated bulb broke at 35 centimeters when struck with a 1" ball and then shattered badly.

Examples 3–10

Incandescent bulbs were coated in a manner similar to Example 1 with an antifragility coating of silicon rubber and glass microspheres except that the coating composition was varied as follows:

| Example No. | Vol. % of Silicon Rubber | Vol. % of Glass Microspheres |
|---|---|---|
| 3 | 78.25 | 21.75 |
| 4 | 72.75 | 27.25 |
| 5 | 67.87 | 32.13 |
| 6 | 63.53 | 36.47 |
| 7 | 59.63 | 40.37 |
| 8 | 56.12 | 43.88 |
| 9 | 52.93 | 47.07 |
| 10 | 50.02 | 49.98 |

Testing of the bulbs of Examples 3–10 against certain standard bulbs resulted in the following:

| Bulb | Gloss[1] | Lum.[2] | Dif.[3] | Break.[4] | Shat.[5] |
|---|---|---|---|---|---|
| Clear Bulb | 10 | 1.06 | 1 | 20 | 3 |
| Frosted Bulb | 10 | 0.92 | 6 | 25 | 2 |
| Saf-T-Coat | 9 | 1.35 | 7 | 25 | 10 |
| Example 3 | 9 | 1.16 | 2 | 30 | 10 |
| Example 4 | 9 | 1.12 | 3 | 30 | 10 |
| Example 5 | 9 | 1.20 | 4 | 25 | 10 |
| Example 6 | 8 | 1.16 | 5 | 40 | 10 |
| Example 7 | 8 | 1.20 | 6 | 45 | 10 |
| Example 8 | 7 | 1.16 | 9 | 55 | 10 |
| Example 9 | 7 | 1.13 | 10 | 35 | 10 |
| Example 10 | 5 | 1.24 | 10 | 50 | 10 |

[1]Subjective rating: 10 = highest gloss; 1 - lowest gloss.
[2]Luminosity—Foot-candles emitted at a distance of 1 foot.
[3]Diffusivity: Subjective rating 10 = best; 1 - poorest.
[4]Breakage—Height required for a ¾" steel ball to fall to cause breakage in centimeters.
[5]Shattering—Subjective rating: 10 = no shattering.

As discussed above, the incandescent bulb of the present invention has several advantages. The most important of which is the antifragility property. The antifragility property of the present invention is due primarily to the sacrificial breakage on impact of the hollow microspheres functioning synergistically with the resiliency of the polymeric binder. In the event of repetitive impact to the same area, some antifragility protection still remains due to the voids left in the resilient polymeric binder.

The polymeric binder of the present invention also prevents scattering of the broken pieces once the glass envelope of the incandescent illuminating device is fractured. In order to provide this antiscattering protection, the antifragility coating of the present invention must have a reasonably high tensile strength and elongation. This requires a balancing of the percentage by volume of the hollow microspheres in the coating since tensile strength tends to increase as the percentage of hollow microspheres is increased while elongation tends to decrease as the percentage of hollow microspheres is increased.

The antifragility coating of the present invention also provides resistance to breakage when the incandescent illuminating device is contacted by cold liquids or objects, such as cold water, or by hot liquids or objects, such as molten iron. Resistance to breakage by hot objects or liquids is a function of the thermal insulating properties of the coating. The thermal insulating properties of the coating of the present invention increase as the amount of microspheres in the coating is increased, but direct contact between the microspheres should be avoided so as not to decrease the antifragility property.

Incandescent illuminating devices coated with the antifragility coating of the present invention also show improved light diffusivity. Improved diffusivity of the present invention is manifest upon comparing a bulb coated with the antifragility coating of the present invention and a bulb coated with prior art silicone rubber safety coatings. In the latter, the glare from the light bulb filament is clearly apparent. In the present invention, the coating so diffuses the light emitted from the filament that enhanced diffusivity is clearly present. Light bulbs coated in accordance with the present invention give the appearance or illusion that light is actually being emitted from the antifragility coating as a secondary emission rather than from the filament itself. Since the light appears to be coming from the antifragility coating of the present invention, the light does subtend a larger retinal angle than light that would come from a smaller filament or point source.

The improved diffusivity of the antifragility coating of the present invention also obviates the need to etch the interior surface of the glass envelope of an electric light bulb in certain instances. It is common to "frost" electric light bulbs by etching, such as with an acid, the inside surface of the glass envelope of the bulb and/or by depositing thereon an inorganic "smoke" such as silica. Etching, of course, causes a glass envelope to be weaker than a clear, unetched envelope. Although many safety bulbs coated with silicone rubbers do not employ etching, the antifragility coating of the present invention applied to a clear envelope creates a more light-diffusing coating and would obviate the need to etch the glass envelope in order to achieve the full frosted effect of frosted or "soft" electric light bulbs commonly sold for residential usage. In the latter case, the antifragility coating increases the impact resistance of the electric light bulb.

A further advantage of the present antifragility coating within the scope of this invention is an increase in the basic efficiency of the light-producing process within the lamp. It is well known in the art of incandescent lamp design that an increase in the temperature of the filament results in an increase in the efficiency of the conversion of electrical energy into radiant energy, and that reducing the rate of loss of thermal energy from the lamp system will serve to increase the luminous efficiency of the lamp at constant voltage, other factors of lamp construction being equal. It has been discovered that coatings within the scope of this invention are effective heat barriers; that is, they are effective heat insulators and present high resistance to the passage of thermal energy. The unusual degree of resistance to the transmission of heat derives from the presence in the coating of voids within hollow microspheres. Thus, in addition to other advantages described in this application, the present invention will enhance the basic light producing process within an incandescent lamp.

The improved diffusivity of the coating of the present invention also leads to improved directional transmissivity of the light bulb. In shock-resistant incandescent lamps, the filament is generally a partially circular member which lies approximately in a plane perpendicular to the longitudinal axis of the light bulb; that is, the partially circular filament faces the "end" of the rounded portion of the bulb. Because of the orientation of the filament, a greater portion of the light is directionally transmitted through the rounded end of the bulb than through the lateral portions of the bulb. This is because in looking at the end of the bulb, one can "see" the entire filament, whereas from the side, the filament appears as a linear member and only a portion of it is "visible". Although the antifragility coating of the present invention does attenuate slightly more light than a clear envelope, a lamp coated using the present invention actually emits more useful light from the side of the bulb than a similar but uncoated bulb. This renders the bulb more useful since, in many applications of shock-resistant lamps, the light transmitted through the end of the bulb usually serves little useful illuminating purpose because of the way in which the bulb is oriented in the fixture. This improved directional transmissivity of the present invention is an additional advantage over the prior art shock-resistant lamps coated only with silcone rubber.

To measure the improved directional transmissivity according to the present invention three frosted bulbs were coated with the antifragility coating of Example 1 and measured for luminous efficiency at 90° to the axis of the bulb. Similarly, three clear bulbs were coated and measured. An effort was made to orient the bulbs so the effect of the open end of the partially circular filament would be the same before and after coating. The results are in the following table:

| Bulb No. | Type | Luminous Efficiency Before Coating | After Coating | Gain | % Gain |
|---|---|---|---|---|---|
| 1 | Frosted | 92 | 104 | +12 | 13.0 |
| 2 | Frosted | 93 | 109 | +16 | 17.2 |
| 3 | Frosted | 92 | 101 | +9 | 9.8 |
| 4 | Clear | 110* | 108 | −2 | −1.8* |
| 5 | Clear | 99 | 106 | +7 | 7.1 |
| 6 | Clear | 97 | 110 | +13 | 13.4 |

-continued

| Bulb No. | Type | Luminous Efficiency Before Coating | After Coating | Gain | % Gain |
|---|---|---|---|---|---|
| Average | | | | +9.2 | 9.8 |

*High reading before coating believed due to surge of house current.

The improved thermal efficiency achieved by the present invention can be shown by the following comparison. Six 100 watt general purpose incandescent bulbs were tested before and after being coated with the antifragility coating of the present invention. In the first two experiments below, the bulbs before and after coating were tested for lumens, amperes, watts and lumens per watt at 120 volts. Then the same six bulbs were tested for lumens, volts, watts and lumens per watts at the amperes corresponding to the amperes of the lamps before treatment. The lamps were rated for luminous flux in an 80 inch spherical photometer after being allowed to stabilize for approximately three minutes. The results of the tests are as follows:

| Lamp No. | 100 Watt Incandescent Lamps Before Treatment Volts | Amps | Watts | Lumens | Lumens Per Watt |
|---|---|---|---|---|---|
| 1 | 120.0 | .7594 | 91.1 | 916 | 10.1 |
| 2 | 120.0 | .7577 | 90.9 | 893 | 9.82 |
| 3 | 120.0 | .7563 | 90.8 | 897 | 9.89 |
| 4 | 120.0 | .7835 | 94.0 | 1030 | 11.0 |
| 5 | 120.0 | .7795 | 93.5 | 970 | 10.4 |
| 6 | 120.0 | .7620 | 91.4 | 932 | 10.2 |

| Lamp No. | 100 Watt Incandescent Lamps After Treatment 120 Volts-Constant Volts | Amps | Watts | Lumens | Lumens Per Watt |
|---|---|---|---|---|---|
| 1 | 120.0 | .7569 | 90.8 | 855 | 9.42 |
| 2 | 120.0 | .7538 | 90.6 | 824 | 9.11 |
| 3 | 120.0 | .7504 | 90.0 | 757 | 8.41 |
| 4 | 120.0 | .7779 | 93.3 | 916 | 9.81 |
| 5 | 120.0 | .7784 | 93.4 | 907 | 9.71 |
| 6 | 120.0 | .7715 | 92.6 | 909 | 9.82 |

| Lamp No. | 100 Watt Incandescent Lamps After Treatment Constant Amperes of Before Treatment Volts | Amps | Watts | Lumens | Lumens Per Watt |
|---|---|---|---|---|---|
| 1 | 120.9 | .7594 | 91.8 | 881 | 9.60 |
| 2 | 121.1 | .7577 | 91.8 | 856 | 9.33 |
| 3 | 121.7 | .7563 | 92.0 | 805 | 8.75 |
| 4 | 121.5 | .7835 | 95.2 | 967 | 10.2 |
| 5 | 120.3 | .7795 | 93.8 | 918 | 9.79 |
| 6 | 117.5 | .7620 | 89.2 | 837 | 9.35 |

The foregoing results demonstrate the improved thermal efficiency due to the antifragility coatings of the present invention. Because of the thermal insulating properties of the antifragility coating, the filament of the bulb reaches a higher temperature than in uncoated bulbs. This causes the resistance of a filament to increase, and since the voltage remains constant, the current or amperage is thereby decreased. With constant voltage, as in the second set of test results, the decrease in current and therefore power consumption is demonstrated in all but one test (bulb No. 6). The decrease in power consumption is also accompanied by an increase in color temperature of the emitted radiation and luminosity. The decrease in power consumption and the increase in luminosity are obviously desirable, and the increase in color temperature (from a yellowish-white to a bluish-white) is usually also desirable. In the third set of test results above, the amperes for each bulb were set according to the first set of test results of the bulbs before treatment and gave similar results.

A further advantage of the present invention is reduced material cost compared to prior art safety coatings. Based on a volumetric standard, the cost of most hollow microspheres is considerably below the cost of the polymeric binders. Thus, the addition of hollow microspheres not only contributes to the other foregoing properties noted above, but it also reduces the material costs of the coating.

What is claimed is:

1. An incandescent illuminating device comprising a glass envelope and an antifragility coating covering at least a substantial portion of said glass envelope, said antifragility coating comprising a mixture of a relatively clear, heat-stable polymer, which is capable of adhering to glass, and a plurality of hollow, heat-stable, frangible microspheres, said hollow microspheres constituting from about 20% to about 60% by volume of the cured antifragility coating and (i) being essentially colorless and having a high degree of light transmissivity, and (ii) having a low bulk density and a diameter less about the thickness of the antifragility coating, and said antifragility coating being from about 3 mils to about 30 mils in thickness, whereby said hollow microspheres will act as a sacrificially frangible material so as to absorb an impact, thus reducing the tendency of the glass envelope to fracture and so as to leave voids in said polymer so as to thereby absorb any further impact in the same area of impact.

2. An incandescent illuminating device as claimed in claim 1 wherein said polymer or a precursor of said polymer is capable of existing in the liquid state either in the neat condition or as a solution, dispersion or emulsion in at least one other liquid medium, so as to facilitate coating application, and wherein said polymer (i) can withstand prolonged exposure to temperatures in excess of about 350° F., (ii) has at least about a 10% elongation at break and (iii) has a high degree of essentially colorless light transmissivity, and said hollow microspheres have a diameter in the range of about 12 microns to about 750 microns.

3. An incandescent illuminating device as claimed in claim 2 wherein said heat-stable polymer is a silicone rubber, said hollow microspheres are hollow silicaceous microspheres having a diameter in the range from about 20 microns to about 200 microns and comprise from about 25% to about 50% by volume of the cured antifragility coating, and said antifragility coating has a coating thickness in the range from about 4 mils to about 12 mils.

4. An incandescent illuminating device as claimed in claim 3 wherein said hollow silicaceous microspheres are composed of a material selected from the group consisting of glass, alkali metal silicates, silicon dioxide and mixtures thereof, said microspheres having a diameter in the range from about 40 microns to about 150 microns and comprising from about 35% by volume to about 45% by volume of the cured antifragility coating, said cured antifragility coating having a thickness from about 6 mils to about 10 mils, and both said silicone rubber and said hollow silicaceous microspheres being stable to prolonged exposure to temperatures in excess of about 400° F.

5. An incandescent illuminating device as claimed in claim 1 and wherein said antifragility coating transmits at least about 85% of the light compared to an uncoated illuminating device.

6. An incandescent illuminating device comprising a glass envelope and an antifragility coating covering at least a substantial portion of said glass envelope and having a relatively uniform thickness, said antifragility coating comprising a mixture of a relatively clear, heat-stable silicone rubber, and a plurality of small, hollow, heat-stable silicaceous microspheres, said silicone rubber (i) being capable of adhering to glass, (ii) being able to withstand prolonged exposure to temperatures in excess of about 350° F., (iii) having a high degree of light transmissivity, (iv) having at least about a 10% elongation at break, and (v) being capable of application as a liquid composition, said hollow silicaceous microspheres constituting from about 25% to about 50% by volume of the cured antifragility coating and (i) being essentially colorless and having a high degree of light transmissivity, and (ii) having a low density and a diameter in the range from about 20 microns to about 200 microns, and said antifragility coating being from about 4 mils to about 12 mils in thickness, whereby said hollow silicaceous microspheres will act as a sacrificially frangible material so as to absorb an impact, thus reducing the tendency of the glass envelope to fracture and so as to leave voids in said silicone rubber so as to thereby absorb any further impact in the same area of impact.

7. An incandescent illuminating device as claimed in claim 6 wherein said hollow silicaceous microspheres are composed of a material selected from the group consisting of glass, alkali metal silicates, silicon dioxide and mixtures thereof, said microspheres having a diameter in the range from about 40 microns to about 150 microns and comprising from about 35% by volume to about 45% by volume of the cured antifragility coating, said cured antifragility coating having a thickness from about 6 mils to about 10 mils, and both said silicone rubber and said hollow silicaceous microspheres being stable to prolonged exposure to temperatures in excess of about 400° F.

8. An incandescent illuminating device as claimed in claim 6 and wherein said antifragility coating transmits at least about 85% of the light compared to an uncoated illuminating device.

9. An incandescent illuminating device comprising a transparent glass envelope having relatively low strength and defining a chamber, said envelope being frangible upon a first force of a given magnitude being applied thereto, a filament for creating light in response to an electric current flowing therethrough located in said chamber, a light-transmitting antifragility polymer coating adhered to the outer surface of said glass envelope, said antifragility polymer coating preventing a scattering of glass in the event said envelope is broken, and light-transmitting, impact-absorbing microspheres in said coating, said microspheres being capable of fracturing or deforming under pressure to absorb an impact of a second force of a magnitude greater than said first force to thereby prevent said second force from being applied to said envelope sufficiently to cause fracture thereof.

* * * * *